US008869399B2

(12) United States Patent
Lesage et al.

(10) Patent No.: US 8,869,399 B2
(45) Date of Patent: Oct. 28, 2014

(54) METHOD OF CONSTRUCTING AN INNER GLASS-LINED STEEL TANK FOR A HOT WATER HEATER

(75) Inventors: Claude Lesage, Pointe Claire (CA); Jean-Claude Lesage, Kirkland (CA)

(73) Assignee: Miclau S.R.I. Inc.

( * ) Notice: Subject to any disclaimer, the term of this patent is extended or adjusted under 35 U.S.C. 154(b) by 733 days.

(21) Appl. No.: 13/187,577

(22) Filed: Jul. 21, 2011

(65) Prior Publication Data

US 2013/0022428 A1 Jan. 24, 2013

(51) Int. Cl.

| | |
|---|---|
| ***B21D 51/24*** | (2006.01) |
| ***B23P 15/26*** | (2006.01) |
| ***B21D 51/18*** | (2006.01) |

(52) U.S. Cl.

CPC ..... *B21D 51/18* (2013.01)
USPC ..... 29/890.051; 29/890.039; 29/890.053

(58) Field of Classification Search

None
See application file for complete search history.

(56) References Cited

U.S. PATENT DOCUMENTS

| | | | | |
|---|---|---|---|---|
| 4,796,344 | A * | 1/1989 | Nunlist | 29/890.039 |
| 4,889,105 | A * | 12/1989 | Vago et al. | 122/13.01 |
| 5,088,192 | A * | 2/1992 | Dempsey | 29/890.037 |
| 5,379,507 | A | 1/1995 | Lindahl | |
| 5,722,149 | A | 3/1998 | Lesage et al. | |
| 2008/0135565 | A1 * | 6/2008 | Zeiler | 220/600 |

* cited by examiner

*Primary Examiner* — Alexander P Taousakis
(74) *Attorney, Agent, or Firm* — Guy J. Houle

(57) ABSTRACT

A method of constructing an inner glass-lined steel tank is described. The lower edge of the top dome shell is machined wherein a smooth angulated surface is formed between an outer and an inner surface of the top dome shell to form a smooth angulated surface to eliminate abrupt transition edges. Also, couplings are machined and press-fitted into the tank wall to form smooth surfaces with the inner surface of the tank. When the porcelain enamel is sprayed inside the tank there are no sharp edges which often results in defects due to the fact that the porcelain enamel is not properly adhered thereto. Such defects eventually cause corrosion within the inner tank and greatly reduce the life expectancy thereof as well as the life expectancy of the sacrificial anode connected to the tank and extending therein.

10 Claims, 2 Drawing Sheets

METHOD OF CONSTRUCTING AN INNER GLASS-LINED STEEL TANK FOR A HOT WATER HEATER

TECHNICAL FIELD

The present invention relates to a method of constructing an inner glass-lined steel tank for a hot water heater and wherein the glass lining has a substantially constant density throughout the inner surface of the tank to prevent corrosion thereof.

BACKGROUND ART

An inner tank of a domestic hot water heater is usually formed by a cylindrical steel container having a circumferential side wall, a top dome shell and a bottom wall shell which are welded together. The container is provided with holes to receive fittings which are welded or screwed thereto. These fittings are required to secure piping to the tank, electric heating elements if the hot water heater is to be heated by electricity, a sacrificial anode and other devise such as temperature sensors, etc. The sacrificial anode, or sacrificial rod, is a metallic anode used in cathodic protection where it is intended to be dissolved to protect other metallic components inside the tank. The more active metal is more easily oxidized than the protected metal and corrodes first, hence the term "sacrificial", and it generally oxidizes nearly completely before the less active metal will corrode, thus acting as a barrier against corrosion for the protected metal. Therefor, the more metal that is exposed inside the tank wall the faster the sacrificial anode will deteriorate and any exposed metal surface will start oxidizing.

Oxidization of exposed metals in hot water heater has been found problematic in the past and attempts have been made to construct the inner casing of the hot water heater of non-corrosive materials. U.S. Pat. No. 5,379,507 describes such a method of manufacture wherein an inner shell of non-corrosive material is cast inside the outer shell while heat is applied to the outer shell. The leak-tight liner is a polymer material such as polyethylene, polyprolyn or nylon. An objective of this design was to substantially reduce the amount of steel required to fabricate the tank as well as preventing corrosion. This would also eliminate the need of a sacrificial anode thereby resulting in a further cost reduction. However, such tanks have not proven efficient due to other problems that it created.

We have found that the life expectancy of the inner steel tanks of hot water heaters can be improved greatly if defects in the glass lining on the inner wall can be eliminated or substantially reduced. One of the major problems which cause corrosion is due to sharp transition areas inside the tank wall and which are caused by weld couplings, element couplings and primarily the joint formed inside the tank wall by the top dome shell and the cylindrical steel shell.

SUMMARY OF INVENTION

It is therefore a feature of the present invention to substantially reduce abrupt transition areas on the inner sidewall of the hot water tank to thereby produce a glass lining of substantially constant density throughout on the inner surface of the tank to thereby greatly reduce the formation of oxidation.

According to the above feature, from a broad aspect, the present invention provides a method of constructing an inner glass-lined steel tank. The method comprises forming an open-ended cylindrical steel shell from a rolled sheet of steel which is welded longitudinally at opposed longitudinal side edges of the sheet when bent to form a cylinder whereby a longitudinal weld is formed free of burrs on an inner surface of the longitudinal steel shell. A bottom wall shell and a top dome shell are formed, with the top dome shell having a flat circumferential edge between an outer and inner surface of the top dome shell. The flat circumferential edge is machined to create a smooth angulated surface in an abrupt transition edge between the flat circumferential edge and the inner surface of the top dome shell. The top dome shell is press-fitted inside a top end portion of the cylindrical steel shell with the marginal section of the outer surface of the top dome shell in tight frictional contact with an inner surface of the top end of the cylindrical steel shell. The smooth angulated surface merges into the inner surface of the cylindrical steel shell. The top dome shell is welded to the cylindrical steel shell all about an outer surface of the cylindrical shell. The inner surface of the press-fitted top dome shell and the inner surface of the cylindrical steel shell is then sand-blasted and a porcelain enamel is sprayed on the sand-blasted inner surfaces. The porcelain enamel is heated to fuse same on the inner surface of the press-fitted top dome shell and the cylindrical steel shell. The inner surface of the bottom steel support shell is also sand-blasted and a porcelain enamel is applied and heated to fuse the porcelain enamel to the inner surface thereof. The bottom steel support shell is press-fitted in a lower open end of the cylindrical shell and welded all about the outer surface of the cylindrical shell.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
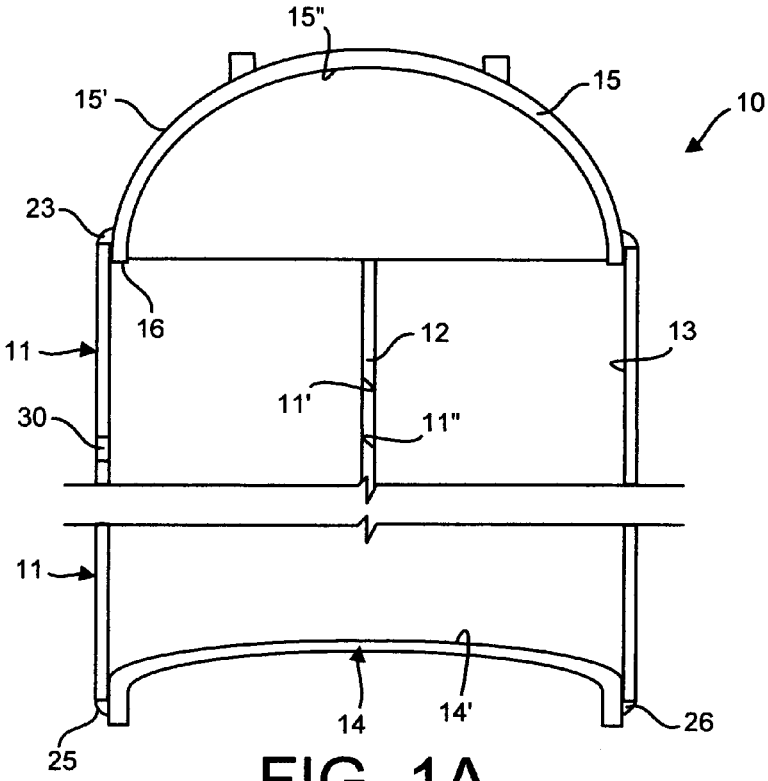
FIG. 1A (PRIOR ART)
FIG. 1A is a fragmented schematic illustration of a top portion of a hot water heater steel tank showing the press-fitted top dome shell and bottom wall shell in opposed opened ends of a cylindrical steel shell.
Figure 1B:
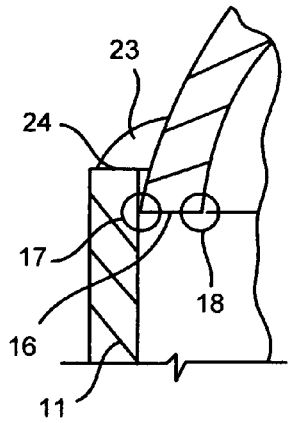
FIG. 1B (PRIOR ART)
FIG. 1B is a fragmented enlarged view illustrating the sharp transition zone of the joint between the top dome shell and the inner surface of the tank side wall.

Referring now to the drawings, and more particularly to FIGS. 1A and 1B, there is shown generally at 10 a top and bottom fragmented portion of a hot water heater inner tank of the prior art. It is comprised essentially of an open-ended cylindrical steel shell 11 formed from a rolled sheet of steel which is welded longitudinally to form a longitudinal weld 12 at opposed longitudinal side edges 11' and 11" of the steel sheet when bent to form a cylinder. The longitudinal weld 12 is a weld formed by any suitable welding technique either manual or automatic such as submerged arc, mig welding, tig or laser welding, etc. with a back-up plate (not shown) positioned flush against the inner surface of the cylindrical steel shell spanning the opposed longitudinal side edges 11' and 11" to form a smooth weld surface free of burrs in the inner surface 13 of the cylindrical steel shell.

A bottom wall shell 14 and a top dome shell 15 are also formed from a sheet of steel. The top dome shell 15 has a flat circumferential edge 16 extending between the outer surface 15' and the inner surface 15" of the top dome shell 15. As hereinshown, this flat circumferential edge 16 creates two abrupt transition zones one defined in the joint area 17 between the inner surface 13 of the cylindrical steel shell 11 and the flat circumferential edge 16, and the other joint area 18 formed between the inner surface 15" of the top dome shell 15 and the flat circumferential edge 16. These abrupt transition zones in the joint areas 17 and 18 make it difficult for the porcelain enamel to adhere thereto and often bare spots or even exposed surface portions will appear in the joint areas 17 and 18 after the porcelain enamel has been baked or after a few years only of use of the hot water heater due to thin glass-lined areas.

Figure 2:
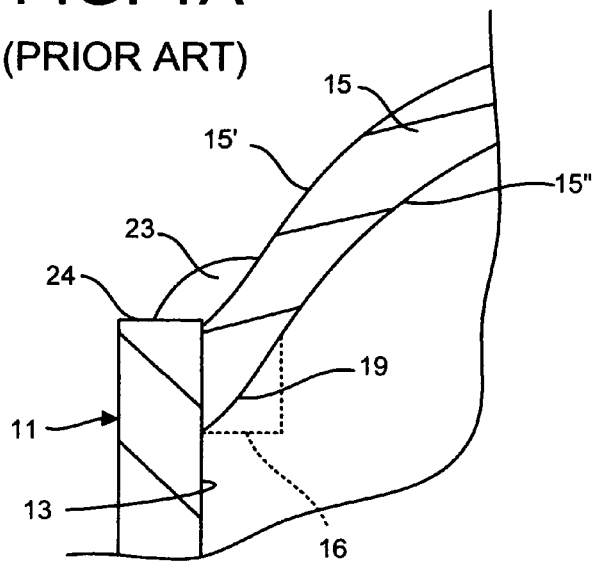
FIG. 2 is an enlarged fragmented section view of a portion of FIG. 1 showing the improvement of the present invention.
Figure 3:
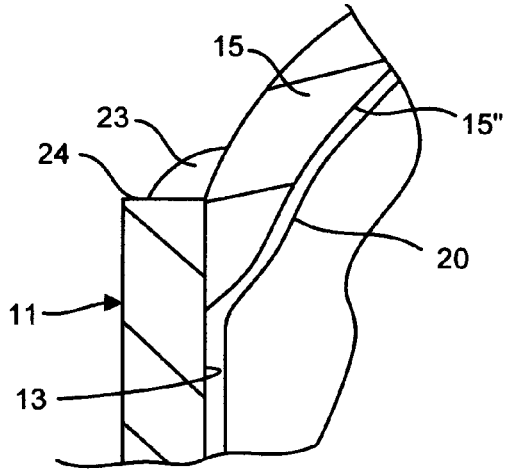
FIG. 3 is an enlarged fragmented section view similar to FIG. 2 and showing the substantially constant density glass lining cured on the inner surface of the tank and extending through a transition zone thereof.

The present invention overcomes this problem by machining the flat circumferential edge 16 as illustrated in FIG. 2 whereby to create a smooth angulated surface 19 between the inner surface 13 of the steel shell 11 and the inner surface 15" of the top dome shell 15. As hereinshown, the smooth angulated surface 19 is an outwardly curved angulated surface to maintain wall thickness and which permits, as shown in FIG. 3, the formation of a glass lining 20 of substantially uniform thickness throughout the transition area 21, which is now a smooth curved transition area.

After the top dome shell 15 is press-fitted inside the top end portion 22 of the cylindrical steel shell 11 with a marginal section of the outer shell of the top dome shell in tight frictional contact with the inner surface of the top end of the cylindrical steel shell, a weld 23 is formed all about the outer surface of the top dome shell and the top edge 24 of the cylindrical steel shell 11.

After the top dome shell 15 and the cylindrical steel shell 11 have been press-fitted together, the entire inner surface of the top dome shell and the cylindrical steel shell is shot-blasted prior to applying a porcelain enamel on the sand-blasted inner surfaces. The porcelain enamel can be sprayed wet or powder coated or slushed. This assembly is then heated in an appropriate oven whereby to fuse the porcelain enamel on the inner surface of the assembled components. The bottom wall shell 14 is also sand-blasted on an inner surface 14' thereof and a porcelain enamel is also sprayed thereon and it is cured in the same fashion as the cylindrical steel shell 11 and the top dome shell 15. It is press-fitted in the bottom open end of the cylindrical steel shell 11 and a weld 25 is formed outwardly between the cylindrical steel shell bottom edge 26 and a lower portion of the side wall 27 of the bottom steel support shell 14.

Figure 4:
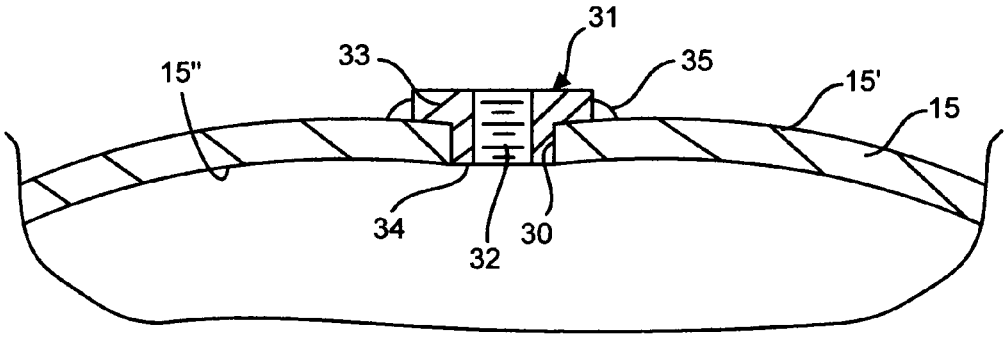
FIG. 4 is a fragmented section view showing a coupling press-fitted in a hole provided in the top dome shell of the steel tank.

As shown in FIGS. 1A and 4, holes 30 are formed in the cylindrical steel shell 11 whereby to receive components associated with the hot water tank 10, such as electrical heating elements or temperature sensors (not shown) which are fitted in these holes. In the present embodiment, these holes are not threaded and are dimensioned such as to receive couplings, such as the coupling 31 illustrated in FIG. 4 in close friction-fit therein.

Figure 5:
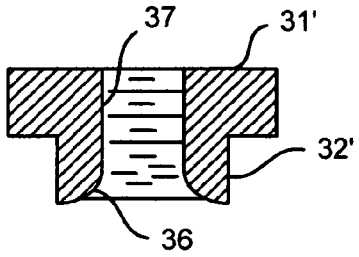
FIG. 5 is a cross-section view of a coupling having a machined smooth inner radius at its bottom end merging with the inner surface of the inner tank.

FIG. 4 shows the top dome shell 15 and wherein the hole 30 formed therein is fitted with an associated coupling 31 which is press-fitted therein. The couplings 31 have a connecting projection 32 and an outer securement flange 33. The connecting projection 32 has a length which is substantially equal to the thickness of the top dome shell 15. When the couplings are press-fitted into the holes 30 they terminate flush with the inner surface 15" of the top dome shell 15 whereby to provide for a uniform coating between the inner surface 15" and the flush outer surface 34 of the connecting projection 32 of the coupling. Accordingly, there are no abrupt edges or transition zones between the inner surfaces of the top dome shell or inner surface 13 of the cylindrical steel wall 11 and the couplings. The couplings could have an inner machined radius for the improving glass distribution and adhesion to the steel, as shown in FIG. 5. The couplings are secured to the tank by an exterior weld 35, as shown in FIG. 4, all about the securement flange 33 and the outer surface 15' of the top dome shell 15.

As shown in FIG. 5, the coupling 31' has a machined smooth inner radius 36 merging from its lower end edge 36 to its inner threaded bore 37 whereby to eliminate the sharp inner edge of the bore and causing the porcelain enamel to coat the lower portion of the curved radius 36.

As can be seen from the present invention, sharp transition zones have been eliminated on the inner surface of the hot water tank particularly in the transition area between the top dome shell and the cylindrical steel shell thereby eliminating or substantially reducing the risk of early oxidation in this transition area. The result is that the life expectancy of the hot water heater has been greatly increased and the life expectancy of the sacrificial anode has also been increased. Because these hot water heaters have term warranties, the cost of writing reports to insurance companies as well as labour costs involved in dismantling a water heater and replacing it and discarding the water heater in an environmental friendly manner, is reduced.

It is within the ambit present of the invention to cover any obvious modifications of the preferred embodiment described herein provided such modifications follow within the scope of the appended claims. It is pointed out that although the preferred embodiment relates to a cylindrical steel shell for a domestic water heater, the invention should not be restricted thereto as it can apply to storage tanks for storing hot or cold water or other liquids which need to be isolated from steel.

We claim:

1. A method of constructing an inner glass-lined steel tank, comprising the steps of:

i) forming an open-ended cylindrical steel shell from a rolled sheet of steel which is welded longitudinally at opposed longitudinal side edges of said sheet when bent to form a cylinder whereby a longitudinal weld is formed free of burrs on an inner surface of said cylindrical steel shell, ii) forming a bottom wall shell and a top dome shell, said top dome shell having a flat circumferential edge between an outer and inner surface of said top dome shell, iii) machining said flat circumferential edge to create a smooth angulated surface in an abrupt transition edge between said flat circumferential edge and said inner surface of said top dome shell, iv) press-fitting said top dome shell inside a top end portion of said cylindrical steel shell with a marginal section of said outer surface of said top dome shell in tight frictional contact with an inner surface of said top and of said cylindrical steel shell, said smooth angulated surface merging into said inner surface of said cylindrical steel shell, v) welding said top dome shell and said cylindrical steel shell, all about an outer surface of said top dome shell, vi) sand-blasting said inner surface of said press-fitted top dome shell and said inner surface of said cylindrical steel shell, vii) applying a porcelain enamel on said sand-blasted inner surfaces, viii) heating said porcelain enamel to fuse same on said inner surface of said press-fitted top dome shell and said cylindrical steel shell, ix) sand blasting an inner surface of said bottom steel support shell and spraying a porcelain enamel on said sand-blasted inner surface and heating same to fuse said porcelain enamel to said inner surface, x) press-fitting a lower end of said cylindrical shell in said bottom steel support shell and, xi) welding said bottom steel support shell all about said outer surface of said cylindrical shell.

2. A method as claimed in claim 1 wherein said step (i) comprises the step of welding said opposed longitudinal side edges with a back-up plate positioned flush against a rear face of said cylindrical steel shell against said opposed longitudinal side edges to form a smooth weld surface free of said burrs in said inner surface of said cylindrical steel shell.

3. A method as claimed in claim 1 wherein said step (iii) comprises machining an angulated surface from adjacent an outer surface of said top dome shell to said inner surface thereof.

4. A method as claimed in claim 1 wherein said cylindrical steel shell and said top dome shell are provided with holes to receive associated couplings therein, each said couplings having a connecting projection and an outer securement flange, said connecting projection having a smooth outer surface, said connecting projection having a length which is substantially equal to the thickness of said top dome shell and said cylindrical steel shell, and press-fitting said connecting projection into an associated one of said holes and effecting a weld about said outer securennent flange to secure same to said outer surface of said cylindrical steel shell or said top dome shell.

5. A method as claimed in claim 4 wherein said connecting projection has an outer smooth surface and disposed substantially in a common plane with said inner surface of said top dome shell.

6. A method as claimed in claim 5 wherein there is further provided the step of machining said outer smooth surface to form a smooth radius surface merging into an inner bore of said coupling.

7. A method as claimed in claim 6 wherein after step (iv) there is provided said step of press fitting said connecting projection of two or more of said couplings in associated ones of said holes with their associated outer securement flange engaging said outer surface about its associated hole.

8. A method as claimed in claim 1 wherein after said step (iv), said smooth angulated surface eliminates any sharp transition zones between same and said inner surface of said cylindrical steel shell and said inner surface of said top dome shell whereby said porcelain enamel will adhere to said inner surfaces throughout a transition zone formed by said smooth angulated surface between said cylindrical steel sheet and said top dome.

9. A method as claimed in claim 3 wherein said angulated surface is an outwardly curved angulated surface.

10. A method as claimed in claim 1 wherein said glass-lined steel tank is a hot water heater steel tank.

* * * * *